US007521645B2

(12) United States Patent
Shea et al.

(10) Patent No.: US 7,521,645 B2
(45) Date of Patent: Apr. 21, 2009

(54) ARC PLATE, AND ARC CHUTE ASSEMBLY AND ELECTRICAL SWITCHING APPARATUS EMPLOYING THE SAME

(75) Inventors: John J. Shea, Pittsburgh, PA (US); Nathan J. Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 231 days.

(21) Appl. No.: 11/533,670

(22) Filed: Sep. 20, 2006

(65) Prior Publication Data

US 2008/0067150 A1 Mar. 20, 2008

(51) Int. Cl.
*H01H 33/08* (2006.01)

(52) U.S. Cl. ..... 218/34; 218/149; 218/151

(58) Field of Classification Search ..... 218/15, 218/34–41, 147–151, 156, 157; 335/16, 335/147, 195, 201

See application file for complete search history.

(56) References Cited

U.S. PATENT DOCUMENTS 3,728,503 A * 4/1973 Clausing et al. ..... 218/149
3,997,746 A 12/1976 Harper et al.
4,511,772 A 4/1985 Link et al.
4,612,426 A * 9/1986 Maier et al. ..... 218/151
5,498,847 A 3/1996 Bennett et al.
5,504,292 A 4/1996 Bennett et al.
6,297,465 B1 10/2001 Groves et al.
6,624,373 B2 9/2003 Raabe et al.
6,794,595 B2 9/2004 Charles et al.
7,034,242 B1 4/2006 Shea et al.

* cited by examiner

*Primary Examiner*—Elvin G Enad
*Assistant Examiner*—Marina Fishman
(74) *Attorney, Agent, or Firm*—Charles E. Kosinski; Martin J. Moran

(57) ABSTRACT

An arc plate for a circuit breaker arc chute assembly includes first and second portions coupled to opposing sidewalls of the arc chute assembly, first and second ends, and a throat portion between the first and second portions and including an aperture. The aperture extends from the first end toward the second end and includes an end section, an intermediate neck section adjacent the end section, and an interior section adjacent the intermediate neck section and distal from the end section. The end section has a first width and attracts and directs an arc toward the intermediate neck section. The intermediate neck section tapers from the first width of the end section to a second width, further attracting the arc and directing it into the interior section. The interior section includes a taper and turns with respect to the intermediate neck section, in order to attract and retain the arc.

4 Claims, 3 Drawing Sheets

ARC PLATE, AND ARC CHUTE ASSEMBLY AND ELECTRICAL SWITCHING APPARATUS EMPLOYING THE SAME

CROSS-REFERENCE TO RELATED APPLICATIONS

This application is related to commonly assigned, concurrently filed:

U.S. patent application Ser. No. 11,533,655, filed Sep. 20, 2006, entitled "ARC BAFFLE, AND ARC CHUTE ASSEMBLY AND ELECTRICAL SWITCHING APPARATUS EMPLOYING THE SAME"; and U.S. patent application Ser. No. 11,533,646, filed Sep. 20, 2006 entitled "GASSING INSULATOR, AND ARC CHUTE ASSEMBLY AND ELECTRICAL SWITCHING APPARATUS EMPLOYING THE SAME", which are hereby incorporated herein by reference.

BACKGROUND OF THE INVENTION

1. Field of the Invention

The invention relates generally to electrical switching apparatus and, more particularly, to arc plates for arc chute assemblies of electrical switching apparatus, such as circuit breakers. The invention also relates to arc chute assemblies for electrical switching apparatus. The invention further relates to electrical switching apparatus having one or more arc chute assemblies.

2. Background Information

Electrical switching apparatus, such as circuit breakers, provide protection for electrical systems from electrical fault conditions such as, for example, current overloads, short circuits, and abnormal level voltage conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

To facilitate this process, circuit breakers typically include arc chute assemblies which are structured to attract and break-up the arcs. Specifically, the movable contacts of the circuit breaker are mounted on arms that are contained in a pivoting assembly which pivots the movable contacts past or through arc chutes as they move into and out of electrical contact with the stationary contacts. Each arc chute includes a plurality of spaced apart arc plates mounted in a wrapper. As the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates. Examples of arc chutes are disclosed in U.S. Pat. Nos. 7,034,242; 6,703,576; and 6,297,465.

Arc chutes and, in particular, the arc plates of the arc chute are designed to encourage the arc to enter the arc plates. For example, it has been known to provide the arc plates of the arc chute with a throat geometry, such as a U-shape or V-shape, which is structured to attract the arc into the arc plates and thus away from the separable contacts. However, the arc can undesirably back out of the arc plates and arc chute, toward the separable contacts. It is, therefore, desirable to not only attract the arc and draw it away from the separable contacts, but also to retain it within the arc chute so that it may be effectively split among the arc plates into a series of smaller arcs and dissipated until the electrical current of the arc is extinguished.

Accordingly, there is room for improvement in arc plates for arc chute assemblies, and in arc chute assemblies for electrical switching apparatus, such as circuit breakers.

SUMMARY OF THE INVENTION

These needs and others are met by embodiments of the invention, which are directed to arc plates with enhanced arc splitting and arc retention for the arc chute assemblies of electrical switching apparatus, such as circuit breakers.

As one aspect of the invention, an arc plate is provided for an arc chute assembly of an electrical switching apparatus. The electrical switching apparatus includes a housing and separable contacts enclosed by the housing. The arc chute assembly may have first and second opposing sidewalls, and may be disposed proximate the separable contacts in order to attract an arc generated by the separable contacts tripping open. The arc plate comprises: a first portion structured to be coupled to one of the first and second opposing sidewalls of the arc chute assembly; a second portion structured to be coupled to the other one of the first and second opposing sidewalls of the arc chute assembly; a first end structured to be disposed proximate the separable contacts of the electrical switching apparatus; a second end disposed distal from the first end; and a throat portion disposed between the first portion and the second portion and including an aperture, the aperture extending from the first end of the arc plate toward the second end of the arc plate and including an end section disposed at or about the first end of the arc plate, an intermediate neck section disposed adjacent the end section, and an interior section disposed adjacent the intermediate neck section and distal from the end section, wherein the end section of the aperture of the throat portion has a first width and is structured to attract the arc and direct the arc toward the intermediate neck section of the aperture of the throat portion, wherein the intermediate neck section of the aperture of the throat portion has a second width and tapers from the first width of the end section of the aperture of the throat portion to the second width of the intermediate neck section, the second width being less than the first width of the end section of the aperture, thereby further attracting the arc and directing the arc into the interior section of the aperture of the throat portion, and wherein the interior section of the aperture of the throat portion includes a taper, the interior section turning with respect to the intermediate neck section of the aperture of the throat portion, in order to attract and retain the arc therein.

The interior section of the aperture of the throat portion of the arc plate may further comprise an expanded portion disposed adjacent the intermediate neck section of the aperture, and having a third width, wherein the third width of the expanded portion is greater than the second width of the intermediate neck section of the aperture and is less than the first width of the end section of the aperture. The interior section may comprise a generally oblong cut-out having a first end comprising the expanded portion, a second end having a fourth width, and the taper. The taper may generally extend from the third width of the expanded portion at the first end of the generally oblong cut-out toward the fourth width of the second end of the generally oblong cut-out, wherein the fourth width of the second end of the generally oblong cut-out is less than the third width of the expanded portion of the first end of the generally oblong cut-out. The generally oblong cut-out may extend generally perpendicularly from the intermediate neck section of the aperture of the throat portion of the arc plate.

The arc plate may include a centerline extending from the first end of the arc plate to the second end of the arc plate intermediate the first portion of the arc plate and the second portion of the arc plate, wherein at least one of the intermediate neck section of the aperture of the throat portion of the arc plate and the interior section of the aperture of the throat portion of the arc plate is asymmetric with respect to the centerline. The aperture of the throat portion may further comprise an edge having a cross-sectional profile, wherein the cross-sectional profile of at least a portion of the edge is tapered in order to further attract the arc into the aperture of the throat portion.

As another aspect of the invention, an arc chute assembly is provided for an electrical switching apparatus including a housing and a pair of separable contacts enclosed by the housing. The separable contacts are structured to trip open resulting in an arc being generated. The arc chute assembly comprises: first and second opposing sidewalls, and a plurality of arc plates disposed between the first and second opposing sidewalls, each arc plate of the plurality of arc plates comprising: a first portion coupled to one of the first and second opposing sidewalls of the arc chute assembly, a second portion coupled to the other one of the first and second opposing sidewalls of the arc chute assembly, a first end structured to be disposed proximate the separable contacts of the electrical switching apparatus, a second end disposed distal from the first end, and a throat portion disposed between the first portion and the second portion and including an aperture, the aperture extending from the first end of the arc plate toward the second end of the arc plate and including an end section disposed at or about the first end of the arc plate, an intermediate neck section disposed adjacent the end section, and an interior section disposed adjacent the intermediate neck section and distal from the end section, wherein the end section of the aperture of the throat portion of the arc plate has a first width and is structured to attract the arc and direct the arc toward the intermediate neck section of the aperture of the throat portion of the arc plate, wherein the intermediate neck section of the aperture of the throat portion of the arc plate has a second width and tapers from the first width of the end section of the aperture of the throat portion to the second width of the intermediate neck section, the second width being less than the first width of the end section of the aperture, thereby further attracting the arc and directing the arc into the interior section of the aperture of the throat portion, and wherein the interior section of the aperture of the throat portion of the arc plate includes a taper, the interior section turning with respect to the intermediate neck section of the aperture of the throat portion of the arc plate, in order to attract and retain the arc within the interior section.

The plurality of arc plates of the arc chute assembly may be substantially identical and may be disposed within the arc chute assembly spaced one on top of another with at least one of the intermediate neck section and the interior section of the aperture of the throat portion of a first one of the arc plates, which is asymmetric, being disposed backwards with respect to at least one of the intermediate neck section and the interior section of the aperture of the throat portion of a second one of the arc plates, which is also asymmetric.

As another aspect of the invention, an electrical switching apparatus comprises: a housing; separable contacts enclosed by the housing; an operating mechanism structured to open and close the separable contacts and to trip open the separable contacts in response to an electrical fault; and at least one arc chute assembly disposed at or about the separable contacts in order to attract and dissipate an arc which is generated by the separable contacts tripping open in response to the electrical fault, the at least one arc chute assembly comprising: first and second opposing sidewalls, and a plurality of arc plates disposed between the first and second opposing sidewalls, each arc plate of the plurality of arc plates comprising: a first portion coupled to one of the first and second opposing sidewalls of the at least one arc chute assembly, a second portion coupled to the other one of the first and second opposing sidewalls of the at least one arc chute assembly, a first end disposed proximate the separable contacts of the electrical switching apparatus, a second end disposed distal from the first end, and a throat portion disposed between the first portion and the second portion, the throat portion including an aperture, the aperture extending from the first end of the arc plate toward the second end of the arc plate, the aperture including an end section disposed at or about the first end of the arc plate, an intermediate neck section disposed adjacent the end section of the arc plate, and an interior section disposed adjacent the intermediate neck section of the arc plate and distal from the end section of the arc plate, wherein the end section of the aperture of the throat portion of the arc plate has a first width and is structured to attract the arc and direct the arc toward the intermediate neck section of the aperture of the throat portion of the arc plate, wherein the intermediate neck section of the aperture of the throat portion of the arc plate has a second width and tapers from the first width of the end section of the aperture of the throat portion to the second width of the intermediate neck section, the second width being less than the first width of the end section of the aperture, thereby further attracting the arc and directing the arc into the interior section of the aperture of the throat portion, and wherein the interior section of the aperture of the throat portion of the arc plate includes a taper, the interior section turning with respect to the intermediate neck section of the aperture of the throat portion of the arc plate, in order to attract and retain the arc within the interior section.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
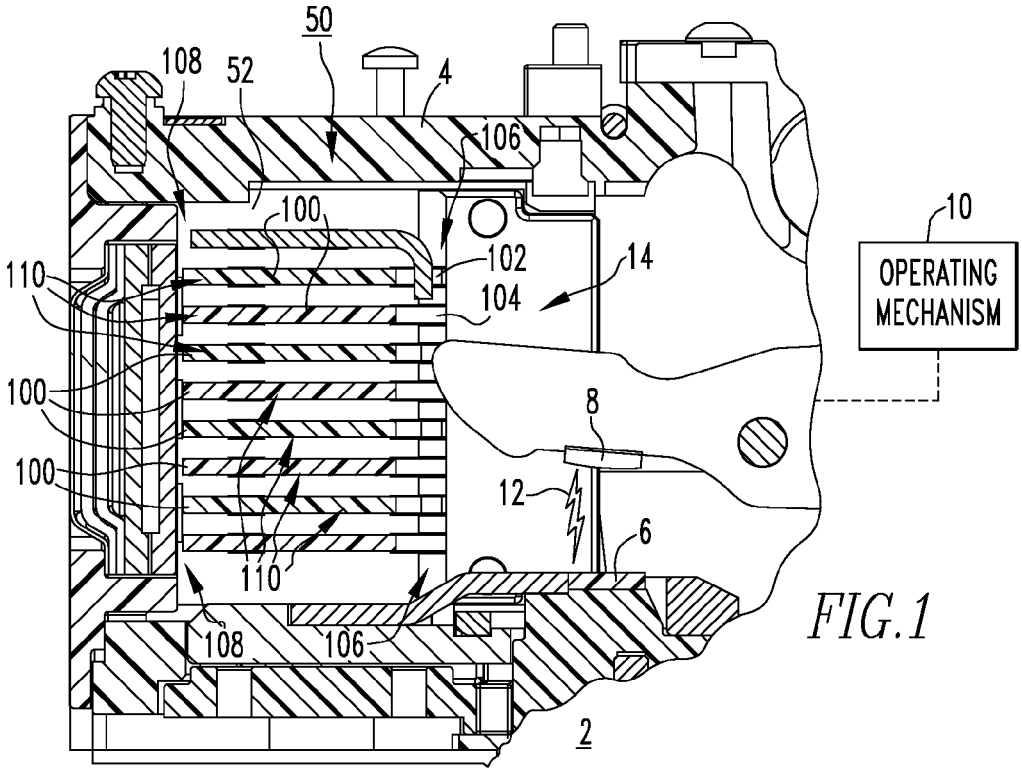
FIG. 1 is a cross-sectional view of a portion of a circuit breaker, including an arc chute assembly and arc plates therefor, in accordance with an embodiment of the invention.

For purposes of illustration, embodiments of the invention will be described as applied to arc chute assemblies for molded case circuit breakers, although it will become apparent that they could also be applied to a wide variety of electrical switching apparatus (e.g., without limitation, circuit switching devices and other circuit interrupters, such as contactors, motor starters, motor controllers and other load controllers) having an arc chute.

Directional phrases used herein, such as, for example, left, right, top, bottom, front, back and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "ionized" means completely or partially converted into ions and electrons and being at least somewhat electrically conductive such as, for example, ionized gases generated by arcing between separable electrical contacts of a circuit breaker when opened.

As employed herein, the term "number" shall mean one or an integer greater than one (i.e., a plurality).

FIG. 1 shows a portion of an electrical switching apparatus, such as a circuit breaker 2, including a housing 4, separable contacts 6,8 (e.g., stationary contact 6 and movable contact 8), enclosed by the housing 4, and an operating mechanism 10 (shown in simplified form in FIG. 1) structured to open and close the separable contacts 6,8. Specifically, the operating mechanism 10 is structured to trip open the separable contacts 6,8 in response to an electrical fault (e.g., without limitation, an overcurrent condition, an overload condition, an undervoltage condition, or a relatively high level short circuit or fault condition). When the separable contacts 6,8 trip open, an arc 12 is generated as shown in FIG. 1. The circuit breaker 2 includes at least one arc chute assembly 50 disposed at or about the separable contacts 6,8 in order to attract and dissipate the arc 12.

Figure 2:
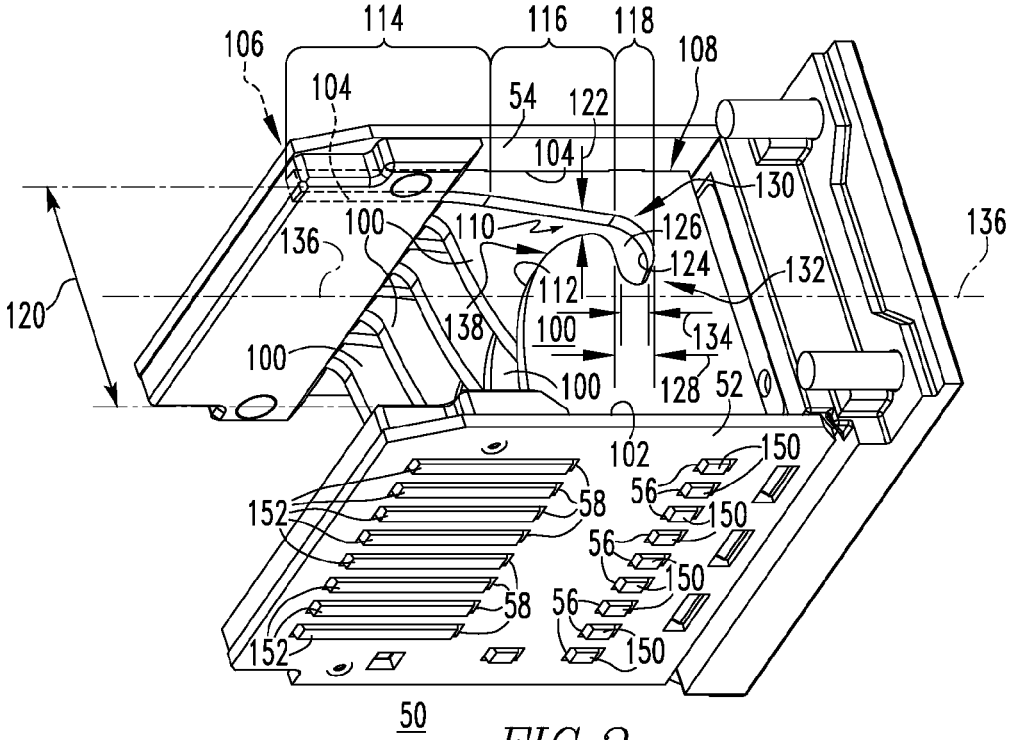
FIG. 2 is an isometric view of the arc chute assembly and arc plates therefor of FIG. 1.
Figure 5:
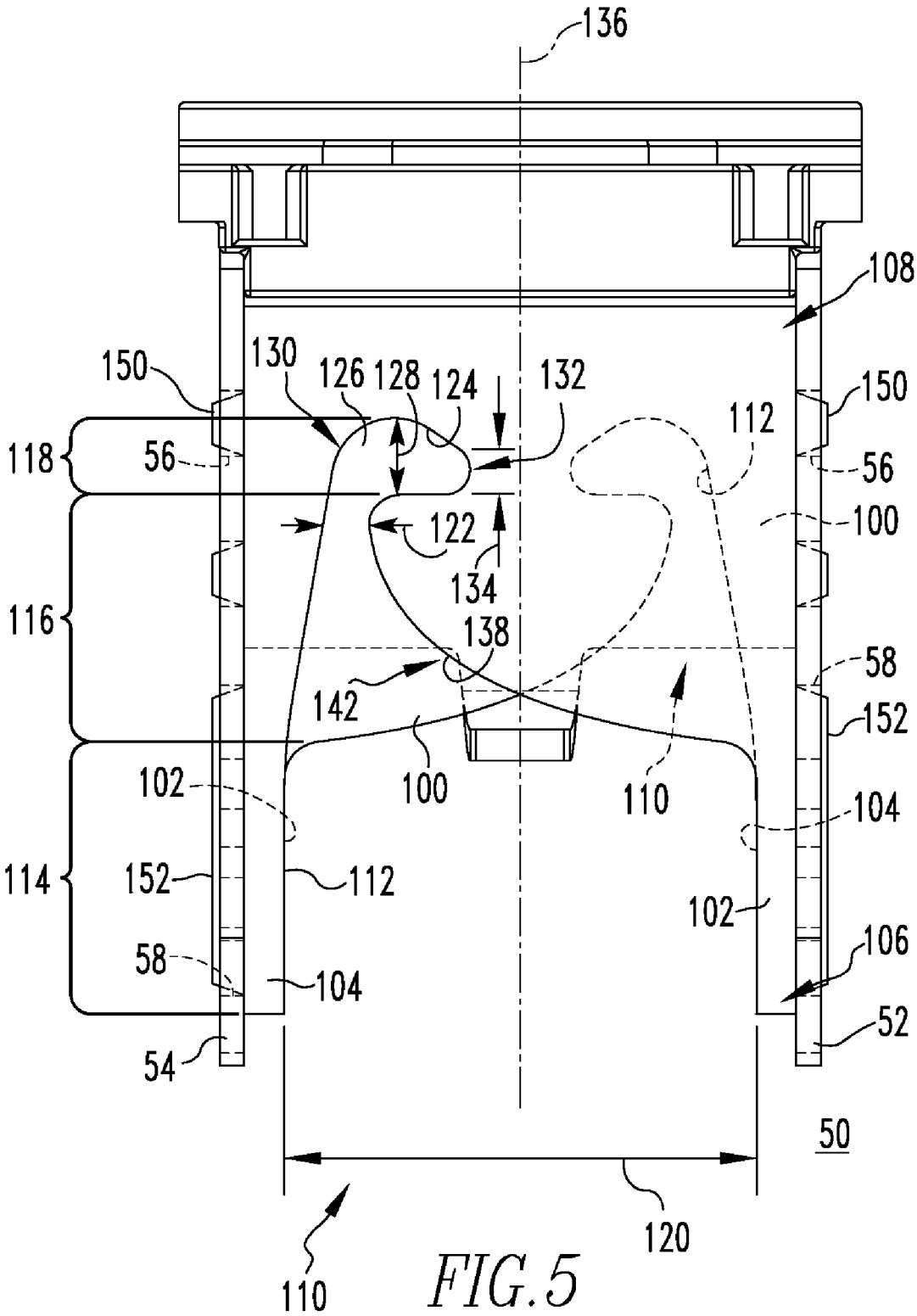
FIG. 5 is a top plan view of the arc chute assembly of FIG. 2, showing one arc plate in solid line drawing and a second, adjacent arc plate in hidden line drawing.

As best shown in FIGS. 2 and 5, each arc chute assembly 50 includes first and second opposing sidewalls 52,54 and a plurality of arc plates 100 disposed between the first and second opposing sidewalls 52,54. More specifically, each of the first and second opposing sidewalls 52,54 of the arc chute assembly 50 includes a plurality of apertures 56,58 (shown only on first opposing sidewall 52 of FIG. 2), and the arc plate 100 includes first and second portions or legs 102,104 each having a number of protrusions 150,152 (shown only in first opposing sidewall 52 of arc chute assembly 50 of FIG. 2). The apertures 56,58 of the first and second opposing sidewalls 52,54 each receive the protrusions 150,152 of a corresponding one of the first and second legs 102,104 of the arc plates 100, as best shown in FIG. 5.

Figure 3:
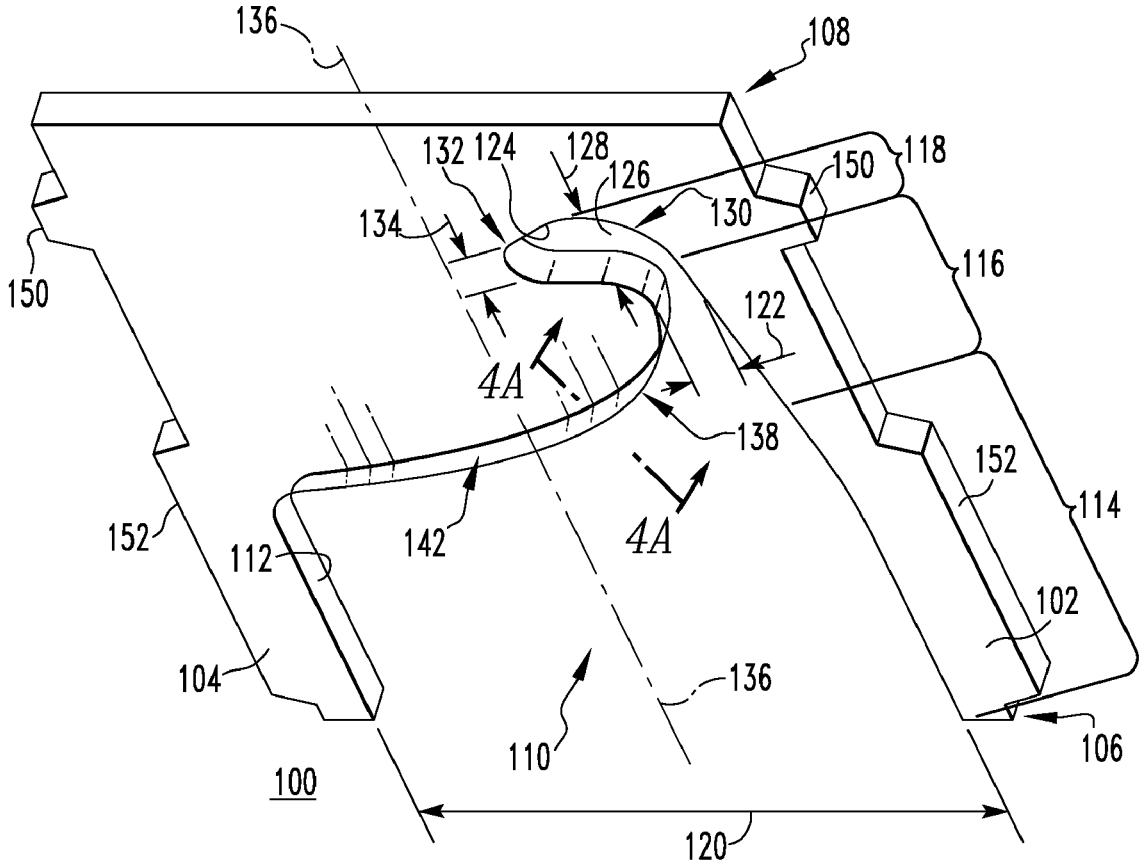
FIG. 3 is an isometric view of one of the arc plates of the arc chute assembly of FIG. 1.

Referring to FIGS. 2, 3 and 5, each arc plate 100 includes the first leg 102, which is structured to be coupled to one of the first and second opposing sidewalls 52,54 (FIGS. 2 and 5) of the arc chute assembly 50 (FIGS. 2 and 5) and the second leg 104 which is structured to be coupled to the other one of the first and second opposing sidewalls 52,54 (FIGS. 2 and 5) of arc chute assembly 50 (FIGS. 2 and 5), as previously discussed, a first end 106 structured to be disposed proximate the separable contacts 6,8 (FIG. 1) of the circuit breaker 2 (FIG. 1), a second end 108 disposed distal from the first end 106, and a throat portion 110 disposed between the first leg 102 and the second leg 104. The throat portion 110 includes an aperture 112 which extends from the first end 106 of the arc plate 100, toward the second end 108 thereof. The aperture 112 includes an end section 114, which is disposed at or about the first end 106 of the arc plate 100, an intermediate neck section 116, which is disposed adjacent the end section 114, and an interior section 118, which is disposed adjacent the intermediate neck section 116 and distal from the end section 114. The end section 114 of the aperture 112 has a first width 120, and is structured to attract the aforementioned arc 12 and direct it toward the intermediate neck section 116 of the aperture 112. The intermediate neck section 116 of the aperture 112 has a second width 122 and tapers from the first width 120 of end section 114 to the second width 122 of the intermediate neck section 116. The second width 122 is preferably less than the first width 120 of the end section 114 of aperture 112, as shown, in order to further attract the arc 12 (FIG. 1) and direct it into the interior section 118 of aperture 112 of throat portion 110. The interior section 118 of aperture 112 of the throat portion 110 also includes a taper 124, and turns with respect to the intermediate neck section 116 of the aperture 112, in order to retain the arc 12 (FIG. 1) therein. For example, from the perspective of FIG. 3, the interior section 118 of the example arc plate 100 turns left with respect to intermediate neck section 116 of the aperture 112 of throat portion 110 of the arc plate 100. However, it will be appreciated that the interior section 118 could alternatively turn or otherwise be configured in any suitable manner to attract and retain the arc 12 (FIG. 1).

Continuing to refer to FIGS. 2, 3 and 5, the structure of the throat portion 110 of arc plate 100 will now be described in further detail. Specifically, the interior section 118 of the aperture 112 of the throat portion 110 preferably comprises an expanded portion 126, such as the generally oblong cut-out 118, shown. The expanded portion 126 of the generally oblong cut-out 118 is disposed adjacent to intermediate neck section 116 of aperture 112, and includes a third width 128 which is greater than the second width 122 of the intermediate neck section 116 of aperture 112, but less than the first width 120 of the end section 114 of aperture 112. The generally oblong cut-out 118 has a first end 130 which comprises the expanded portion 126 of the interior section 118, a second end 132 having a fourth width 134, and a taper 124 generally extending therebetween. The fourth width 134 of the second end 132 of the generally oblong cut-out 118 is less than the third width 128 of the expanded portion 126 of the first end 130 of the generally oblong cut-out 118, as shown. The taper 124 helps to electromagnetically attract the arc 12 (FIG. 1) into the interior section 118 of the aperture 112 for retention therein. Specifically, when the arc is initiated in front of the arc plates, the magnetic forces are such that the arc 12 (FIG. 1) will begin to move toward section 138. Gas forces also help to drive the arc into the throat portion 110. As the arc 12 (FIG. 1) moves into the throat portion 110, the magnetic forces increases on the arc 12 (FIG. 1) because the throat portion 110 narrows. This forces the arc 12 (FIG. 1) into interior section 118 which is expanded to allow the arc 12 (FIG. 1) to expand and reside. If the arc 12 (FIG. 1) tries to move back out of the throat portion 110, the metal in section 116 will produce more metal vapor, forcing it back into interior section 118. Once it is in interior section 118, the arc 12 (FIG. 1) prefers to reside in the expanded portion 126 thereof. In this manner, the example arc plate 100 and, in particular, the interior section 118 of aperture 112 of the throat portion 110 of arc plate 100, overcomes the disadvantage (e.g., undesirable withdraw of the arc from the arc plate back towards the separable contacts of the circuit breaker) of the known prior art.

Although the generally oblong cut-out 118 of the example arc plate 100 shown and described herein extends generally perpendicularly from the intermediate neck section 116 of the aperture 112 of throat portion 110 of the arc plate 100, it will be appreciated that it could alternatively extend at any suitable angle (not shown) which would achieve the desired result of retaining the arc 12 (FIG. 1), as preciously discussed.

The arc plate 100 includes a center line 136 extending from the first end 106 to the second end 108 of the arc plate 100 intermediate the first and second legs 102,104 of the arc plate 100, as shown in FIGS. 2, 3 and 5. At least one of the intermediate neck section 116 and the interior section 118 of the aperture 112 of throat portion 110 of the arc plate 100 is asymmetric with respect to the centerline 136. In the example shown and described herein, both the intermediate neck section 116 and interior section 118 of the arc plates 100 are asymmetric with respect to the centerline 136.

As best shown in FIG. 5, the plurality of arc plates 100 (two arc plates 100 are shown in FIG. 5, a top (from the perspective of FIG. 5) arc plate 100 shown in solid line drawing, and underlying substantially identical arc plate 100 partially shown in hidden line drawing) of the arc chute assembly 50 are substantially identical and are disposed within the arc chute assembly 50 spaced one on top of another with the asymmetric portions 116,118 of the alternating arc plates 100 being disposed backwards with respect to the asymmetric portions 116,118 of adjacent substantially identical arc plates 100. In other words, as best shown in FIG. 5, every other arc plate 100 is flipped with respect to adjacent arc plates 100. For example, in FIG. 5, the top arc plate 100, shown in solid line drawing, is arranged within the arc chute assembly 50 such that the protrusions 150,152 of the first portion or leg 102 of the arc plate 100 are received by apertures 56,58 of the first opposing sidewall 52 of the arc chute assembly 50, and the protrusions 150,152 of the second portion or leg 104 of the arc plate 100 are received by apertures 56,58 of the second opposing sidewall 54 of the arc chute assembly 50. Conversely, the second arc plate 100, partially shown in hidden line drawing in FIG. 5, is coupled to the arc chute assembly 50 such that the protrusions 150,152 of the first portion or leg 102 of the arc plate 100 are received by apertures 56,58 of the second opposing sidewall 54 of the arc chute assembly 50, and the protrusions 150,152 of the second portion or leg 104 of the arc plate 100 are received by apertures 56,58 of the first opposing sidewall 52 of the arc chute assembly 50. In this manner, the substantially identical arc plates 100 are disposed opposite with respect to one another such that the aforementioned asymmetric portions (e.g., intermediate neck section 116 and interior section 118) are mirrored with respect to one another about centerline 136. It will, however, be appreciated that the arc plate 100 need not necessarily be identical. It will also be appreciated that the plurality of arc plates 100 of the arc chute assembly 50 can be arranged in any other known or suitable configuration other than the alternating back-and-forth arrangement shown in FIGS. 2 and 5. For example and without limitation, the sections 114,116,118 of each arc plate 100 of arc chute assembly 50 could be slightly different (not shown), and the arc plates 100 could be stacked within the arc chute assembly 50 all having the same orientation (not shown), in order to direct the arc 12 (FIG. 1) within the arc chute assembly 50 in any predetermined desired manner.

Figure 4A:
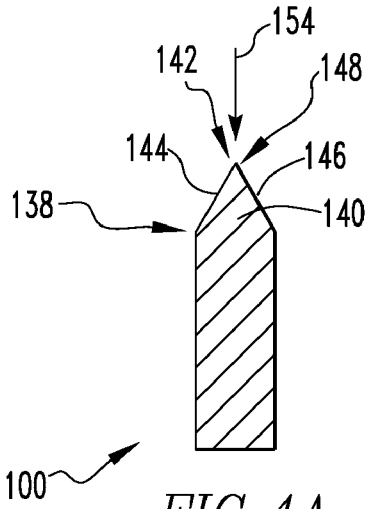
FIG. 4A is a cross-sectional view taken along line 4A-4A of FIG. 3, showing the edge profile of the throat portion of the arc plate.

As best shown in FIG. 3, the aperture 112 of throat portion 110 of arc plate 100 further includes an edge 138. The edge 138 has a cross-sectional profile 140 which is shown in FIG. 4A. Specifically, as shown in FIG. 4A, at least a portion 142 of the edge 138 of the aperture 112 (FIG. 3) of the throat portion 110 (FIG. 3) is tapered in order to further attract the arc 12 (FIG. 1) into the aperture 112 (FIG. 3) of throat portion 110 (FIG. 3) of the arc plate 100. It will be appreciated that the portion 142 of the edge 138 of aperture 112 (FIG. 3) may comprise the entire edge (not shown) of the aperture 112 (FIG. 3) of the throat portion 110 (FIG. 3), or only a smaller section of the aperture 112 (FIG. 3), such as, for example, the intermediate neck section 116 of the aperture 112 in the example of FIG. 3, which is tapered.

Figure 4B:
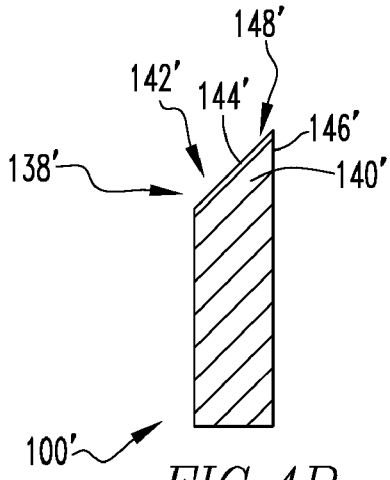
FIG. 4B is a cross-sectional view showing an edge profile for the throat portion of an arc plate in accordance with another embodiment of the invention.

More specifically, FIGS. 4A and 4B illustrate two non-limiting alternative cross-sectional profiles 140,140' for the portion 142,142' of the edge 138,138' of the aperture 112 (FIG. 3) of throat portion 110 (FIG. 3), respectively. In the example of FIG. 4A, the portion 142 of the edge 138 of the throat portion 110 (FIG. 3) of the arc plate 100 has a first side 144 and a second side 146, both of which include a taper 148. In this manner, the tapered portion 142 of edge 138 functions to electromagnetically attract the aforementioned arc 12 (FIG. 1) toward the arc plate 100 in the direction generally indicated by arrow 154 in FIG. 4A. This further serves to direct the arc 12 (FIG. 1) within the arc plate 100, and retain it therein, as desired.

In the example of FIG. 4B, the tapered portion 142' of the edge 138' of arc plate 100' includes a taper 148' on the first side 144' of portion 142', but not the second side 146' thereof. It will, however, be appreciated that any known or suitable tapered edge cross-sectional profile other than the examples shown and described herein could be alternatively employed without departing from the scope of the invention. It will further be appreciated that in other embodiments of the invention, no taper (e g., 148,148') of any portion of the edge 138 of the arc plate 100 is employed.

It will also be appreciated that although the arc plates 100 have been shown and described herein with respect to a single arc chute assembly 50 (FIGS. 1, 2, and 5) for a circuit breaker 2 (FIG. 1), the electrical switching apparatus (erg., circuit breaker 2) could employ more than one arc chute assembly 50 each having a plurality of arc plates 100. For example, and without limitation, the circuit breaker 2 (FIG. 1) could be a multi-pole circuit breaker 2 having a plurality poles (only one pole 14 is expressly shown in FIG. 1) and a corresponding number of arc chute assemblies 50 with arc plates 100 for the poles 14 of the multi-pole circuit breaker 2.

Accordingly, an arc plate geometry and arc chute assembly configuration are disclosed which effectively attract, direct, and retain arcs generated, for example, by the tripping open of the separable contacts 6,8 (FIG. 1) of the circuit breaker 2 (FIG. 1) in response to an electrical fault. Thus, such arcs 12 (FIG. 1) are advantageously drawn away from the separable contacts 6,8 (FIG. 1) and dissipated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc plate for an arc chute assembly of an electrical switching apparatus including a housing and separable contacts enclosed by said housing, said arc chute assembly having first and second opposing sidewalls end being disposed proximate said separable contacts in order to attract an arc generated by said separable contacts tripping open, said arc plate comprising:

a first portion structured to be coupled to one of said first and second opposing sidewalls of said arc chute assembly;

a second portion structured to be coupled to the other one of said first and second opposing sidewalls of said arc chute assembly;

a first end structured to be disposed proximate said separable contacts of said electrical switching apparatus;

a second end disposed distal from the first end;

a throat portion disposed between said first portion and said second portion and including an aperture, said aperture extending from the first end of said arc plate toward the second end of said arc plate and including an end section disposed at or about the first end of said arc plate, an intermediate neck section disposed adjacent said end section, and an interior section disposed adjacent said intermediate neck section and distal from said end section, wherein said end section of said aperture of said throat portion has a first width and is structured to attract said arc and direct said arc toward said intermediate neck section of said aperture of said throat portion, wherein said intermediate neck section of said aperture of said throat portion has a second width and tapers from the first width of said end section of said aperture of said throat portion to the second width of said intermediate neck section, the second width being less than the first width of said end section of said aperture, thereby further attracting said arc and directing said arc into said interior section of said aperture of said throat portion, wherein said interior section of said aperture of said throat portion includes a taper, said interior section turning with respect to said intermediate neck section of said aperture of said throat portion, in order to attract and retain said arc therein; and wherein said aperture of said throat portion of said arc plate further comprises an edge; wherein said edge has a cross-sectional profile; and wherein said cross-sectional profile of at least a portion of said edge of said throat portion is tapered in order to further attract said arc into said aperture of said throat portion.

2. The arc plate of claim 1 wherein said at least a portion of said edge of said throat portion of said arc plate has a first side and a second side; and wherein said at least a portion of said edge includes a taper on one of: (a) the first side of said at least a portion of said edge, (b) the second side of said at least a portion of said edge, and (c) both the first side and the second side of said at least a portion of said edge.

3. An arc chute assembly for an electrical switching apparatus including a housing and a pair of separable contacts enclosed by said housing, said separable contacts being structured to trip open, an arc being generated in response to said separable contacts tripping open, said arc chute assembly comprising:

first and second opposing sidewalls, and a plurality of arc plates disposed between said first and second opposing sidewalls, each arc plate of said plurality of arc plates comprising:

a first portion coupled to one of said first and second opposing sidewalls of said arc chute assembly, a second portion coupled to the other one of said first and second opposing sidewalls of said arc chute assembly, a first end structured to be disposed proximate said separable contacts of said electrical switching apparatus, a second end disposed distal from the first end, a throat portion disposed between said first portion and said second portion and including an aperture, said aperture extending from the first end of said arc plate toward the second end of said arc plate and including an end section disposed at or about the first end of said arc plate, an intermediate neck section disposed adjacent said end section, and an interior section disposed adjacent said intermediate neck section and distal from said end section, wherein said end section of said aperture of said throat portion of said arc plate has a first width and is structured to attract said arc and direct said arc toward said intermediate neck section of said aperture of said throat portion of said arc plate, wherein said intermediate neck section of said aperture of said throat portion of said arc plate has a second width and tapers from the first width of said end section of said aperture of said throat portion to the second width of said intermediate neck section, the second width being less than the first width of said end section of said aperture, thereby further attracting said arc and directing said arc into said interior section of said aperture of said throat portion, wherein said interior section of said aperture of said throat portion of said arc plate includes a taper, said interior section turning with respect to said intermediate neck section of said aperture of said throat portion of said arc plate, in order to attract and retain said arc within said interior section; and wherein said aperture of said throat portion of said arc plate further comprises an edge; wherein said edge has a cross-sectional profile; and wherein said cross-sectional profile of at least a portion of said edge of said aperture of said throat portion is tapered in order to further attract said arc into said aperture.

4. An electrical switching apparatus comprising:

a housing;

separable contacts enclosed by said housing;

an operating mechanism structured to open and close said separable contacts and to trip open said separable contacts in response to an electrical fault;

at least one arc chute assembly disposed at or about said separable contacts in order to attract and dissipate an arc which is generated by said separable contacts tripping open in response to said electrical fault, said at least one arc chute assembly comprising:

first and second opposing sidewalls, a plurality of arc plates disposed between said first and second opposing sidewalls, each arc plate of said plurality of arc plates comprising:

a first portion coupled to one of said first and second opposing sidewalls of said at least one arc chute assembly, a second portion coupled to the other one of said first and second opposing sidewalls of said at least one arc chute assembly, a first end disposed proximate said separable contacts of said electrical switching apparatus, a second end disposed distal from the first end, a throat portion disposed between said first portion and said second portion, said throat portion including an aperture, said aperture extending from the first end of said arc plate toward the second end of said arc place, said aperture including an end section disposed at or about the first end of said arc plate, an intermediate neck section disposed adjacent said end section of said arc plate, and an interior section disposed adjacent said intermediate neck section of said arc plate and distal from said end section of said arc plate, wherein said end section of said aperture of said throat portion of said arc plate has a first width and is structured to attract said arc and direct said are toward said intermediate neck section of said aperture of said throat portion of said arc plate, wherein said intermediate neck section of said aperture of said throat portion of said arc plate has a second width and tapers from the first width of said end section of said aperture of said throat portion to the second width of said intermediate neck section, the second width being less than the first width of said end section of said aperture, thereby further attracting said arc and directing said arc into said interior section of said aperture of said throat portion, wherein said interior section of said aperture of said throat portion of said arc plate includes a taper, said interior section turning with respect to said intermediate neck section of said aperture of said throat portion of said arc plate, in order to attract and retain said arc within said interior section; and wherein said aperture of said throat portion of said arc plate further comprises an edge; wherein said edge has a cross-sectional profile; and wherein said cross-sectional profile of at least a portion of said edge of said aperture of said throat portion is tapered in order to further attract said arc into said aperture.

* * * * *